US011325383B2

(12) United States Patent
Kanazawa et al.

(10) Patent No.: US 11,325,383 B2
(45) Date of Patent: May 10, 2022

(54) LIQUID COLLECTING DEVICE, LIQUID EJECTING APPARATUS, AND METHOD FOR CONTROLLING LIQUID EJECTING APPARATUS

(71) Applicant: SEIKO EPSON CORPORATION, Tokyo (JP)

(72) Inventors: Yuji Kanazawa, Shiojiri (JP); Naoki Yokoyama, Shiojiri (JP); Masanobu Yamaguchi, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/063,845

(22) Filed: Oct. 6, 2020

(65) Prior Publication Data

US 2021/0107285 A1 Apr. 15, 2021

(30) Foreign Application Priority Data

Oct. 9, 2019 (JP) ..... JP2019-185847

(51) Int. Cl.
*B41J 2/165* (2006.01)
*B41J 2/17* (2006.01)

(52) U.S. Cl.
CPC ..... *B41J 2/16517* (2013.01); *B41J 2/1721* (2013.01)

(58) Field of Classification Search
CPC .. B41J 2/1721; B41J 2/16517; B41J 2/16535; B41J 2002/1655
See application file for complete search history.

(56) References Cited

U.S. PATENT DOCUMENTS 9,067,415 B2 * 6/2015 Fukuda ..... B41J 2/16505
2003/0189614 A1 10/2003 Steinfield et al.
2010/0201724 A1 * 8/2010 Yamaguchi ..... B41J 2/52 347/9
2013/0120495 A1 5/2013 Nakamura et al.
2013/0222475 A1 8/2013 Inoue
2013/0257980 A1 10/2013 Ibe et al.
(Continued)

FOREIGN PATENT DOCUMENTS

EP 2631073 A1 * 8/2013 ..... B41J 2/16535
JP 2003-300329 10/2003
(Continued)

*Primary Examiner* — Sharon Polk
(74) *Attorney, Agent, or Firm* — Workman Nydegger

(57) ABSTRACT

A liquid ejecting apparatus includes a liquid ejecting portion that ejects a liquid, a belt-shaped member absorbs the liquid, a feeding portion that retains the belt-shaped member in a rolled state, a pressing portion presses a contact portion of a portion of the belt-shaped member wound off from the feeding portion and bring the contact portion into contact with the liquid ejecting portion, the contact portion being located in a contact area, a winding portion moves the contact portion in a moving direction by winding up the belt-shaped member, and a control portion that, when it is assumed that a contact length is a length of the contact portion along the direction of movement, causes the winding portion to wind up the belt-shaped member corresponding to a length longer than the contact length after bringing the contact portion into contact with the liquid ejecting portion.

13 Claims, 10 Drawing Sheets

(56) References Cited

U.S. PATENT DOCUMENTS

| | | | | |
|---|---|---|---|---|
| 2014/0035996 | A1* | 2/2014 | Gros Gras | B41J 2/16535<br>347/33 |
| 2014/0368577 | A1 | 12/2014 | Ibe et al. | |
| 2019/0255854 | A1* | 8/2019 | Asano | B41J 2/16538 |

FOREIGN PATENT DOCUMENTS

| | | |
|---|---|---|
| JP | 2013-103378 | 5/2013 |
| JP | 2013-173245 | 9/2013 |
| JP | 2013-226798 | 11/2013 |
| JP | 2015-000509 | 1/2015 |
| JP | 2016-147376 | 8/2016 |
| JP | 2018-158477 | 10/2018 |

* cited by examiner

LIQUID COLLECTING DEVICE, LIQUID EJECTING APPARATUS, AND METHOD FOR CONTROLLING LIQUID EJECTING APPARATUS

The present application is based on, and claims priority from JP Application Serial Number 2019-185847, filed Oct. 9, 2019, the disclosure of which is hereby incorporated by reference herein in its entirety.

BACKGROUND

1. Technical Field

The present disclosure relates to a liquid collecting device, a liquid ejecting apparatus, and a method for controlling a liquid ejecting apparatus.

2. Related Art

For example, JP-A-2003-300329 discloses a printer serving as an example of a liquid ejecting apparatus that performs printing by ejecting an ink serving as an example of a liquid through a print head serving as an example of a liquid ejecting portion. The printer includes a cleaning device serving as an example of a liquid collecting device having a web supply source serving as an example of a feeding portion that supplies a web serving as a belt-shaped member and a spindle serving as an example of a winding portion that winds up the web. The cleaning device causes the web supplied from the web supply source to slide on the print head and thereby causes the web to absorb the ink.

The liquid absorbed into the belt-shaped member diffuses within the belt-shaped member. In particular, when the liquid wet-spreads upstream of a contact area that makes contact with the liquid ejecting portion, the contact area tends to, even after the belt-shaped member has been wound up, remain with a portion to which the liquid is adhering, posing a risk of wiping the liquid ejecting portion with the belt-shaped member with the liquid adhering thereto.

SUMMARY

According to an aspect of the present disclosure, there is provided a liquid collecting device including: a belt-shaped member configured to absorb a liquid; a feeding portion that has a feeding shaft and that retains the belt-shaped member in a rolled state; a pressing portion configured to press a contact portion of a portion of the belt-shaped member wound off from the feeding portion and bring the contact portion into contact with a liquid ejecting portion configured to eject the liquid, the contact portion being located in a contact area; and a winding portion that has a winding shaft and that is configured to move the contact portion in a direction of movement by winding up the belt-shaped member, wherein a slope of a portion of the belt-shaped member that extends downstream along the direction of movement and toward a lower position in a slope area provided downstream of the pressing portion along the direction of movement is larger than a slope of a portion of the belt-shaped member that extends upstream of the pressing portion along the direction of movement and toward a lower position than the pressing portion.

According to an aspect of the present disclosure, there is provided a liquid ejecting apparatus including: a liquid ejecting portion that ejects a liquid; a belt-shaped member configured to absorb the liquid; a feeding portion that has a feeding shaft and that retains the belt-shaped member in a rolled state; a pressing portion configured to press a contact portion of a portion of the belt-shaped member wound off from the feeding portion and bring the contact portion into contact with the liquid ejecting portion, the contact portion being located in a contact area; a winding portion that has a winding shaft and that is configured to move the contact portion in a direction of movement by winding up the belt-shaped member; and a control portion that, when it is assumed that a contact length is a length of the contact portion along the direction of movement, causes the winding portion to wind up the belt-shaped member by a length longer than the contact length after bringing the contact portion into contact with the liquid ejecting portion.

According to an aspect of the present disclosure, there is provided a method for controlling a liquid ejecting apparatus including a liquid ejecting portion that ejects a liquid, a belt-shaped member configured to absorb the liquid, a feeding portion that retains the belt-shaped member in a rolled state, a pressing portion configured to press a contact portion of a portion of the belt-shaped member wound off from the feeding portion and bring the contact portion into contact with the liquid ejecting portion, the contact portion being located in a contact area, and a winding portion configured to move the contact portion in a direction of movement by winding up the belt-shaped member, the method including, when it is assumed that a contact length is a length of the contact portion along the direction of movement, causing the winding portion to wind up the belt-shaped member by a length longer than the contact length after bringing the contact portion into contact with the liquid ejecting portion.

DESCRIPTION OF EXEMPLARY EMBODIMENTS

Figure 1:
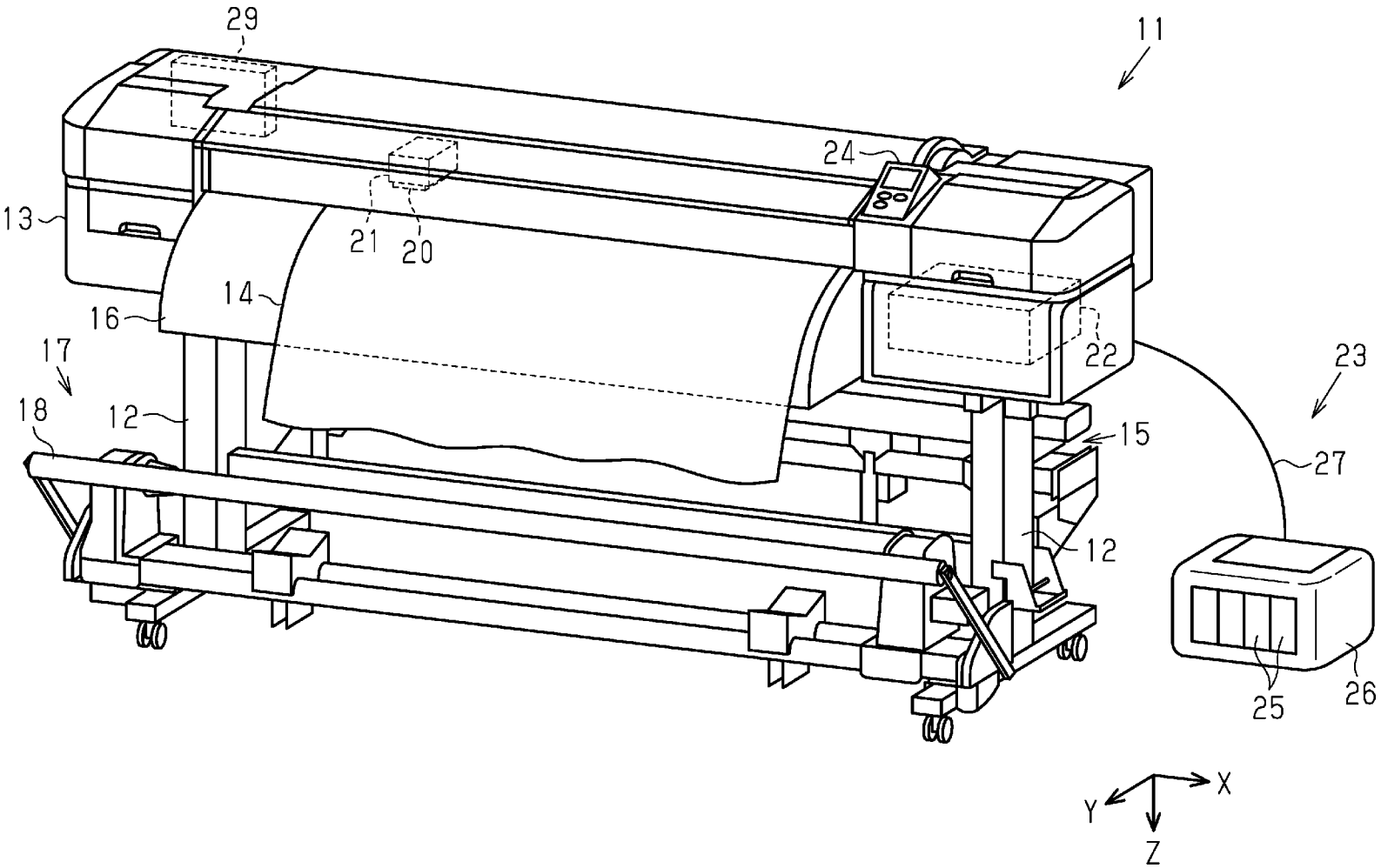
FIG. 1 is a perspective view of a liquid ejecting apparatus according to an embodiment.

A liquid collecting device, a liquid ejecting apparatus, and a method for controlling a liquid ejecting apparatus according to an embodiment are described below with reference to the drawings. The liquid ejecting apparatus is for example an ink-jet printer that performs printing by ejecting an ink serving as an example of a liquid onto a medium such as a sheet of paper.

In the drawings, which assume that a liquid ejecting apparatus 11 is placed on a horizontal plane, the Z axis represents a direction of gravitational force and the X and Y axes represent directions parallel to the horizontal plane. The X axis, the Y axis, and the Z axis are orthogonal to one another. The following description refers to the direction parallel to the X axis also as "width direction X", refers to the direction parallel to the Y axis also as "depth direction Y", and refers to the direction parallel to the Z axis also as "direction of gravitational force Z".

As shown in FIG. 1, the liquid ejecting apparatus 11 may include a pair of leg portions 12 and a housing 13 assembled on top of the leg portions 12. The liquid ejecting apparatus 11 may include a feeding portion 15 that unwinds and feeds a medium 14 wound into a roll, a guiding portion 16 that guides the medium 14 passing out of the housing 13, and the recovery portion 17 that winds up and recovers the medium 14. The liquid ejecting apparatus 11 may include a tension application mechanism 18 that applies tension to the medium 14 being recovered by the recovery portion 17.

The liquid ejecting apparatus 11 includes a liquid ejecting portion 20 capable of ejecting a liquid, a carriage 21 that moves the liquid ejecting portion 20, and a maintenance unit 22 that performs maintenance of the liquid ejecting portion 20. The liquid ejecting apparatus 11 may include a liquid supply device 23 that supplies a liquid to the liquid ejecting portion 20 and an operation panel 24 that is operated by a user. The carriage 21 causes the liquid ejecting portion 20 to reciprocate along the X axis. The liquid ejecting portion 20 prints on the medium 14 by, while moving, ejecting a liquid supplied through the liquid supply device 23.

The liquid supply device 23 includes a fitting portion 26 into which a plurality of liquid holders 25 holding liquids are detachably fitted and a supply flow passage 27 through which a liquid is supplied to the liquid ejecting portion 20 from a liquid holder 25 fitted in the fitting portion 26.

The liquid ejecting apparatus 11 includes a control portion 29 that controls how the liquid ejecting apparatus 11 operates. The control portion 29 is constituted, for example, by including a CPU, a memory, and the like. The control portion 29 controls the liquid ejecting portion 20, the liquid supply device 23, the maintenance unit 22, and the like through the execution by a CPU of a program stored in the memory.

Figure 2:
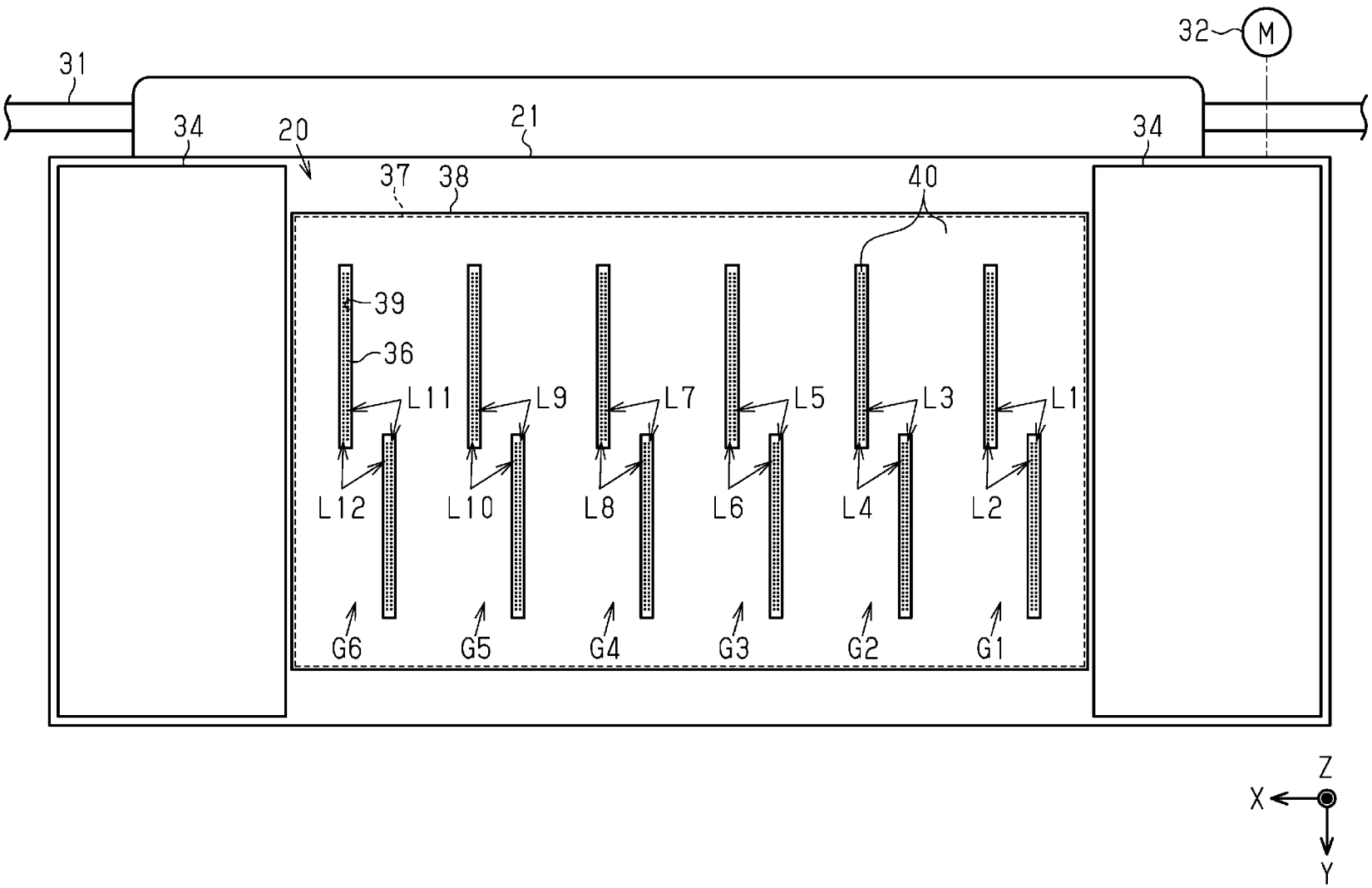
FIG. 2 is a schematic bottom view of a liquid ejecting portion and a carriage.

As shown in FIG. 2, the liquid ejecting apparatus 11 may include a guide shaft 31 that supports the carriage 21 and a carriage motor 32 that moves the carriage 21. The guide shaft 31 extends in the width direction X. The control portion 29 controls driving of the carriage motor 32 and thereby causes the carriage 21 and the liquid ejecting portion 20 to reciprocate along the guide shaft 31.

The liquid ejecting apparatus 11 may include air rectification portions 34 that are retained in a lower portion of the carriage 21. The air rectification portions 34, provided on both sides, respectively, of the liquid ejecting portion 20 in the width direction X, make it easy to rectify a current of air around the liquid ejecting portion 20 reciprocating along the X axis.

The liquid ejecting portion 20 includes a nozzle forming member 37 by which a plurality of nozzles 36 are formed and a cover member 38 that covers a portion of the nozzle forming member 37. The cover member 38 is constituted by metal such as stainless steel. The cover member 38 has formed therein a plurality of through-holes 39 bored through the cover member 38 in the direction of gravitational force Z. The cover member 38 so covers a side of the nozzle forming member 37 on which the nozzles 36 are formed that the nozzles 36 are exposed through the through-holes 39. A nozzle surface 40 is formed by including the nozzle forming member 37 and the cover member 38. Specifically, the nozzle surface 40 is constituted by the nozzle forming member 37, which is exposed through the through-holes 39, and the cover member 38, whereby the nozzles 36, which eject liquids, are formed.

In the liquid ejecting portion 20, the nozzles 36, which eject liquids, each have a large number of orifices unidirectionally arranged at regular intervals. The plurality of nozzles 36 constitute nozzle lines. In the present embodiment, the orifices of the nozzles 36 are arranged in the depth direction Y to constitute first to twelfth nozzle lines L1 to L12. One nozzle line is constituted by nozzles 36 that eject the same type of liquid. One nozzle line is constituted by nozzles 36 that include a nozzle 36 located behind in the depth direction Y and a nozzle 36 located in front in the depth direction Y, and these two nozzles 36 are formed in places out of line with each other in the width direction X.

Every two of the first to twelfth nozzle lines L1 to L12 are arranged in proximity to each other in the width direction X. In the present embodiment, two nozzle lines arranged in proximity to each other are referred to as "nozzle group". In the liquid ejecting portion 20, first to sixth nozzle groups G1 to G6 are placed at regular intervals in the width direction X.

Specifically, the first nozzle group G1 includes the first nozzle line L1, which ejects a magenta ink, and the second nozzle line L2, which ejects a yellow ink. The second nozzle group G2 includes the third nozzle line L3, which ejects a cyan ink, and the fourth nozzle line L4, which ejects a black ink. The third nozzle group G3 includes the fifth nozzle line L5, which ejects a light cyan ink, and the sixth nozzle line L6, which ejects a light magenta ink. The fourth nozzle group G4 includes the seventh and eighth nozzle lines L7 and L8, which eject treatment liquids. The fifth nozzle group G5 includes the ninth nozzle line L9, which ejects a black ink, and the tenth nozzle line L10, which ejects a cyan ink. The sixth nozzle group G6 includes the eleventh nozzle line L11, which ejects a yellow ink, and the twelfth nozzle line L12, which ejects a magenta ink.

Next, the maintenance unit 22 is described.

Figure 3:
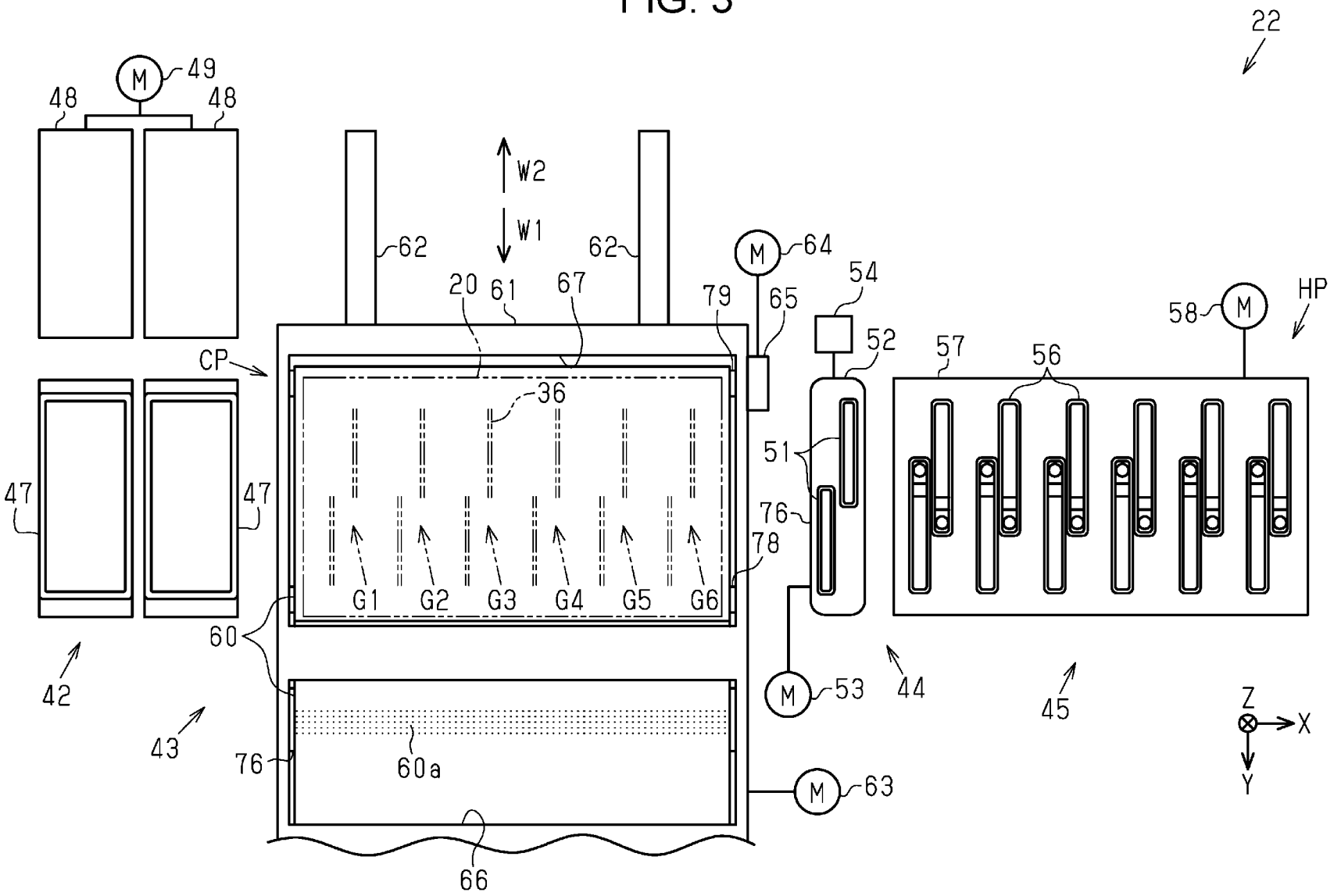
FIG. 3 is a schematic plan view of a maintenance unit.

As shown in FIG. 3, the maintenance unit 22 has a flushing device 42, a liquid collecting device 43, a suction device 44, and a capping device 45 that are arranged in the width direction X. A position above the capping device 45 serves as a home position HP of the liquid ejecting portion 20. The home position HP serves as a starting point at which the liquid ejecting portion 20 starts to move. A position above the liquid collecting device 43 serves as a cleaning position CP of the liquid ejecting portion 20. FIG. 3 uses chain double-dashed lines to indicate the liquid ejecting portion 20 located in the cleaning position CP.

The flushing device 42 receives a liquid that is ejected from the liquid ejecting portion 20 by flushing. Flushing is maintenance by which to eject a liquid as a waste liquid for the purpose of preventing and eliminating clogging of the nozzles 36.

The flushing device 42 includes a liquid receiving portion 47 that receives a liquid ejected by the liquid ejecting portion 20 for flushing, a lid member 48 for covering an opening of the liquid receiving portion 47, and a lid motor 49 that moves the lid member 48. The flushing device 42 may include a plurality of the liquid receiving portions 47 and a plurality of lid members 48. The control portion 29 may select a liquid receiving portion 47 according to the type of liquid. In the present embodiment, the flushing device 42 includes two liquid receiving portions 47 one of which receives a plurality of color inks that are ejected by flushing from the liquid ejecting portion 20 and the other of which receives a treatment liquid that are ejected by flushing from the liquid ejecting portion 20. The liquid receiving portion 47 may hold a moisturizing liquid.

Driving of the lid motor 49 causes the lid member 48 to move between a covering position (not illustrated) in which the lid member 48 covers the opening of the liquid receiving portion 47 and an exposing position (shown in FIG. 3) in which the lid member 48 exposes the opening of the liquid receiving portion 47. When flushing is not performed, the lid member 48 moves to the covering position and thereby reduces drying of the moisturizing liquid held or the liquid received.

The suction device 44 includes a suction cap 51, a suction retainer 52, a suction motor 53 that causes the suction retainer 52 to reciprocate along the Z axis, and a decompression mechanism 54 that reduces the pressure inside the suction cap 51. The suction motor 53 causes the suction cap 51 to move between a contact position and a retreat position. The contact position is a position in which the suction cap 51 surrounds the nozzles 36 in contact with the liquid ejecting portion 20. The retreat position is a position in which the suction cap 51 is away from the liquid ejecting portion 20. The suction cap 51 may be configured to surround all of the nozzles 36 en bloc, may be configured to surround at least one nozzle group, or may be configured to surround one or more of nozzles 36 constituting a nozzle group. In the present embodiment, the suction device 44 surrounds one of the first to sixth nozzle groups G1 to G6 with two suction caps 51.

The liquid ejecting apparatus 11 may perform suction cleaning by which to surround one nozzle group by locating the liquid ejecting portion 20 above the suction device 44 and locating the suction cap 51 in the contact position and discharge a liquid from the nozzles 36 by reducing the pressure inside the suction cap 51. That is, the suction device 44 may receive a liquid that is discharged by suction cleaning.

The capping device 45 has a standby cap 56, a standby retainer 57, and a standby motor 58 that causes the standby retainer 57 to reciprocate along the Z axis. Driving of the standby motor 58 causes the standby retainer 57 and the standby cap 56 to move upward or downward. The standby cap 56 moves from a separated position, i.e. a downward position, to a capping position, i.e. an upward position, and makes contact with the liquid ejecting portion 20 stopping at the home position HP.

When located in the capping position, the standby cap 56 surrounds the orifices of the nozzles 36 constituting the first to sixth nozzle groups G1 to G6. Such maintenance by which the standby cap 56 surrounds the orifices of the nozzles 36 is referred to as "standby capping". Standby capping is a type of capping. Standby capping reduces drying of the nozzles 36.

The standby cap 56 may be configured to surround all of the nozzles 36 en bloc, may be configured to surround at least one nozzle group, or may be configured to surround one or more of nozzles 36 constituting a nozzle group.

Next, the liquid collecting device 43 is described.

As shown in FIG. 3, the liquid collecting device 43 includes a belt-shaped member 60 capable of absorbing a liquid. The liquid collecting device 43 may include a case 61 that holds the belt-shaped member 60, a pair of rails 62 that extend along the Y axis, a wiping motor 63, a winding motor 64, and a power transmission mechanism 65 that transmits the motive power of the winding motor 64. The case 61 includes a first opening 66 and a second opening 67 through which the belt-shaped member 60 is exposed. When the size of the belt-shaped member 60 in the width direction X is equal to or larger than the size of the nozzle surface 40, the liquid ejecting portion 20 can be efficiently maintained.

As shown in FIG. 3, the case 61 is caused by the motive power of the wiping motor 63 to reciprocate along the Y axis on the rails 62. Specifically, the case 61 moves between a waiting position shown in FIG. 4 and a receiving position shown in FIG. 3. When the wiping motor 63 is driven in a forward direction, the case 61, which is located in the waiting position, moves toward the receiving position in a first wiping direction W1 parallel to the Y axis. When the wiping motor 63 is driven in a reverse direction, the case 61, which is located in the receiving position, moves toward the waiting position in a second wiping direction W2 opposite to the first wiping direction W1.

The liquid ejecting apparatus 11 may perform wiping on the liquid ejecting portion 20 in at least either a process by which the case 61 moves from the waiting position to the receiving position and a process by which the case 61 moves from the receiving position to the waiting position. Wiping is maintenance by which to wipe the nozzle surface 40 with the belt-shaped member 60.

Figure 4:
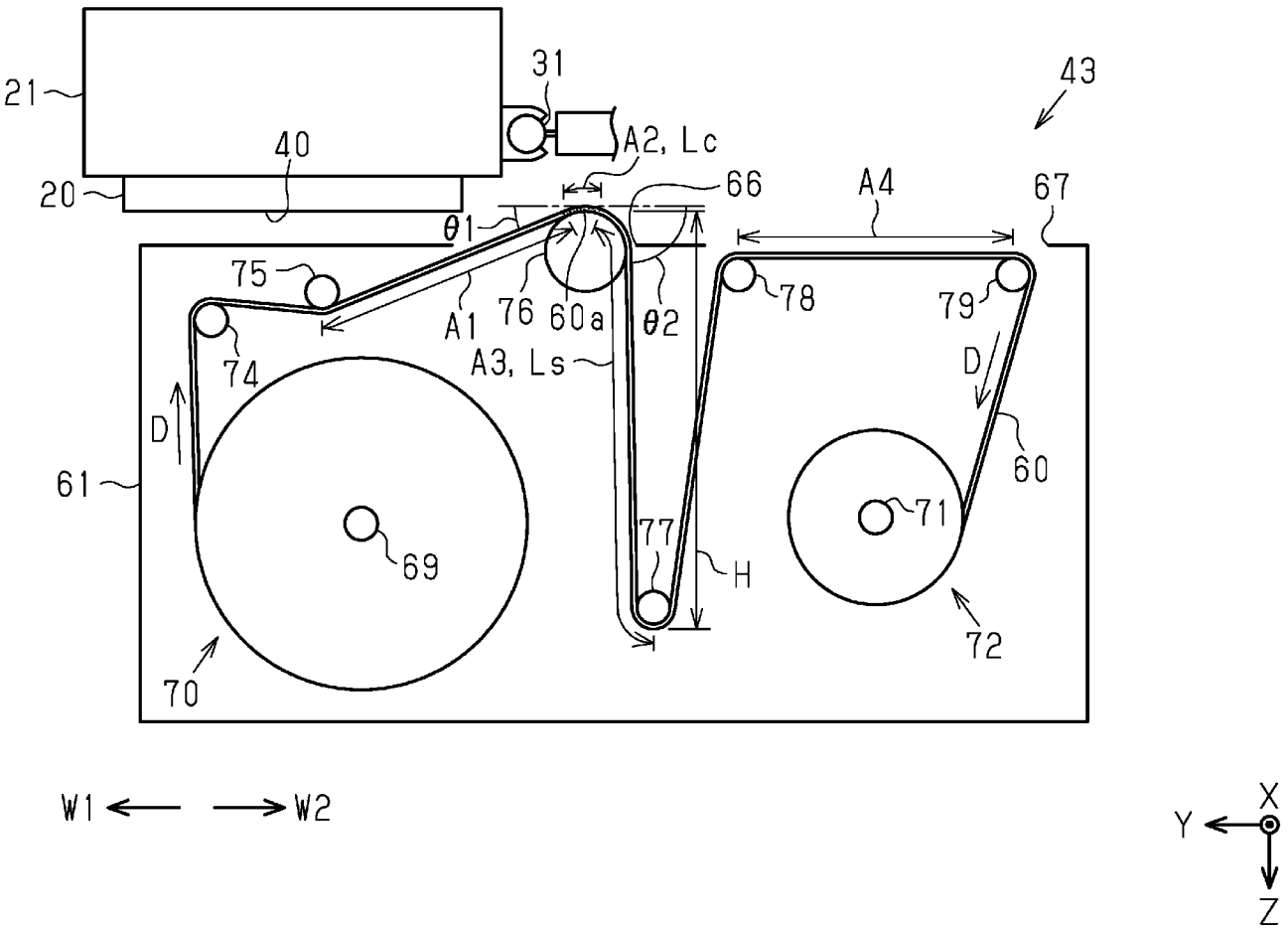
FIG. 4 is a schematic side view of a liquid collecting device with its case located in a waiting position.

As shown in FIG. 4, the liquid collecting device 43 includes a feeding portion 70 having a feeding shaft 69 and a winding portion 72 having a winding shaft 71. The feeding portion 70 retains the belt-shaped member 60 in a rolled state. A portion of the belt-shaped member 60 fed by being unwound from the feeding portion 70 is transported to the winding portion 72 along a path of transportation. The liquid collecting device 43 may include an upstream roller 74, a tension roller 75, a pressing portion 76, a regulating roller 77, a first horizontal roller 78, and a second horizontal roller 79 that are provided in this order from upstream along the path of transportation of the belt-shaped member 60. The case 61 supports the feeding shaft 69, the upstream roller 74, the tension roller 75, the pressing portion 76, the regulating roller 77, the first horizontal roller 78, the second horizontal roller 79, and the winding shaft 71 so that they can rotate on axes parallel to the X axis.

The winding shaft 71 is driven by the winding motor 64 to rotate. The winding portion 72 winds up the belt-shaped member 60 into a roll around the winding shaft 71. The winding portion 72, by winding up the belt-shaped member 60, causes a portion of the belt-shaped member 60 unwound from the feeding portion 70 to move in a direction of movement D. The direction of movement D is a direction parallel to the path of transportation of the belt-shaped member 60, and is a direction from the feeding portion 70, which is located upstream, toward the winding portion 72, which is located downstream.

The power transmission mechanism 65 may couple the winding motor 64 to the winding shaft 71 when the case 61 is located in the waiting position and decouple the winding motor 64 from the winding shaft 71 when the case 61 is away from the waiting position. The winding motor 64 may drive at least one of the upstream roller 74, the tension roller 75, the pressing portion 76, the regulating roller 77, the first horizontal roller 78, and the second horizontal roller 79 to rotate together with the winding shaft 71.

The tension roller 75 is disposed upstream of the pressing portion 76 along the direction of movement D and in a lower position than the pressing portion 76 along the direction of gravitational force Z. The tension roller 75 applies tension to the belt-shaped member 60 by pressing the belt-shaped member 60 downward.

In the present embodiment, the pressing portion 76 is a roller around which the belt-shaped member 60 is wound.

The pressing portion 76 presses, from a lower position toward a higher position, a portion of the belt-shaped 60 wound off from the feeding portion 70, and causes the belt-shaped member 60 to project from the first opening 66.

The regulating roller 77 is disposed downstream of the pressing portion 76 along the direction of movement D and in a lower position than the pressing portion 76 along the direction of gravitational force Z. The regulating roller 77 applies tension to the belt-shaped member 60 by pressing the belt-shaped member 60 downward, and regulates the belt-shaped member 60 toward a lower position than the pressing portion 76.

The path of transportation may have an upstream area A1 located upstream of the pressing portion 76, a contact area A2 in which the belt-shaped member 60 can be brought into contact with the liquid ejecting portion 20, a slope area A3 in which the belt-shaped member 60 slopes with respect to the horizontal plane, and a horizontal area A4 in which the belt-shaped member 60 is kept substantially horizontal.

The upstream area A1 is an area that extends from the lowermost portion of the tension roller 75 to the upstream end of the contact area A2. The pressing portion 76 is located downstream of the tension roller 75 along the direction of movement D and in a higher position than the tension roller 75. Therefore, a portion of the belt-shaped member 60 located in the upstream area A1 forms an upward slope that extends upward in a direction opposite to the direction of gravitational force Z as its extends downstream along the direction of movement D. In the present embodiment, an upstream angle θ1 formed by a horizontal plane indicated by a dot-and-dash line in FIG. 4 and a portion of the belt-shaped member 60 located in the upstream area A1 is smaller than 30 degrees. The upstream angle θ1 is an angle formed by a portion of the belt-shaped member 60 that is located in the contact area A2 and that is out of contact with the pressing portion 76 or the tension roller 75 and the horizontal plane.

Figure 5:
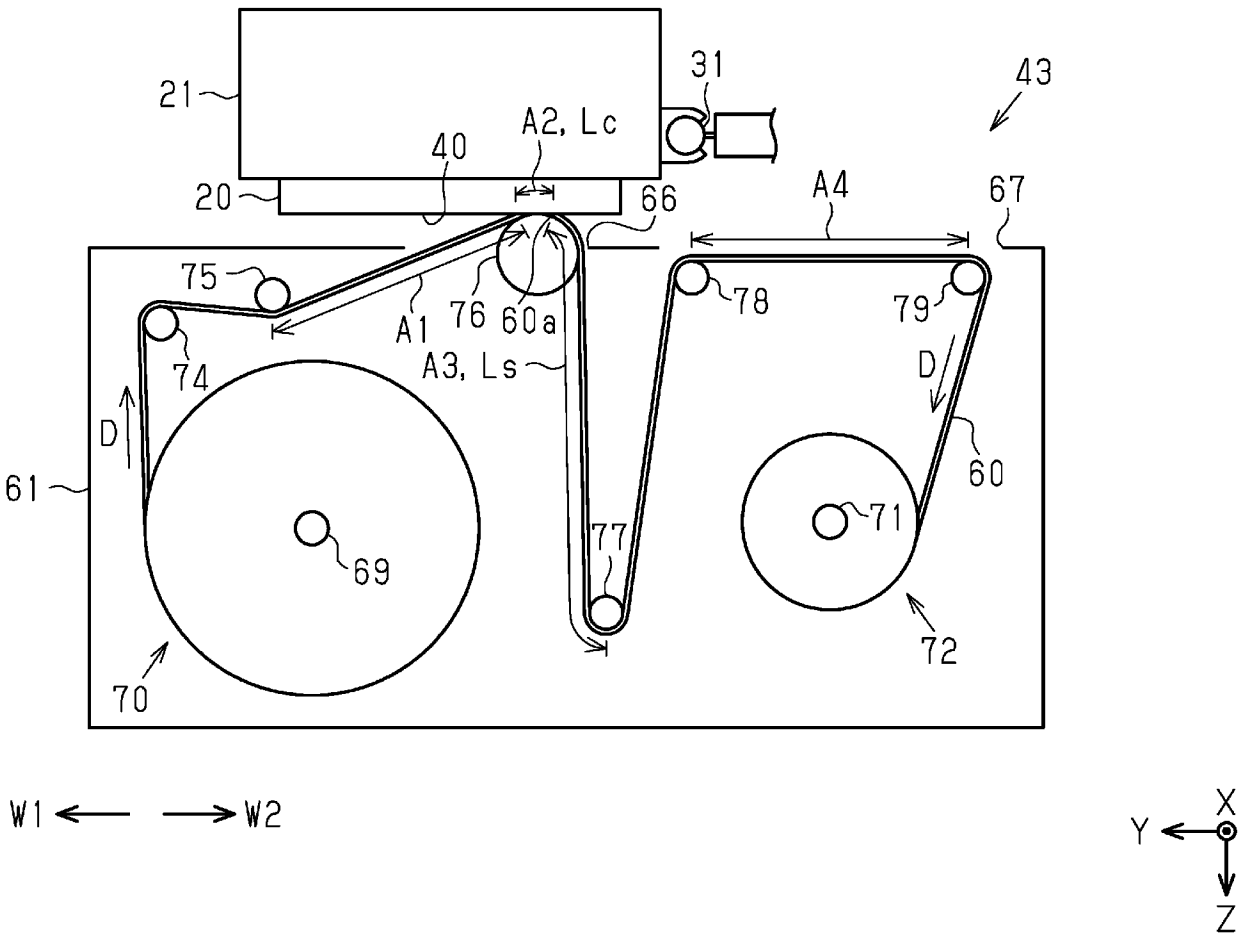
FIG. 5 is a schematic side view of the liquid collecting device wiping the liquid ejecting portion.

As shown in FIGS. 4 and 5, the contact area A2 is an area that makes contact with the liquid ejecting portion 20 in performing wiping. The pressing portion 76 can press a contact portion 60*a* of the belt-shaped member 60 located in the contact area A2 and bring the contact portion 60*a* into contact with the liquid ejecting portion 20. That is, the liquid collecting device 43 performs wiping on the liquid ejecting portion 20 by moving the case 61 with the contact portion 60*a* brought into contact with the liquid ejecting portion 20. In the drawings, the contact portion 60*a* is indicated by half-tone dot meshing.

As shown in FIG. 4, the slope area A3 is provided downstream of the pressing portion 76 along the direction of movement D. The slope area A3 is an area that extends from the downstream end of the contact area A2 to the lowermost portion of the regulating roller 77 with which the belt-shaped member 60 makes contact. The regulating roller 77 is located downstream of the pressing portion 76 along the direction of movement D and in a lower position than the pressing portion 76. Therefore, a portion of the belt-shaped member 60 located in the slope area A3 forms a downward slope that extends downward along the direction of gravitational force Z as it extends downstream along the direction of movement D. In the present embodiment, a downward angle θ2 formed by the horizontal plane and the portion of the belt-shaped member 60 located in the slope area A3 is larger than 30 degrees. That is, a slope with respect to the horizontal plane of a portion of the belt-shaped member 60 that extends downstream along the direction of movement D and toward a lower position in the slope area A3 is larger than a slope with respect to the horizontal plane of a portion of the belt-shaped member 60 that extends upstream of the pressing portion 76 along the direction of movement D and toward a lower position than the pressing portion 76.

The slope length Ls of the slope area A3 along the direction of movement D may be longer than the contact length Lc of the contact portion 60*a* along the direction of movement D. The height H of the slope area A3 along the direction of gravitational force Z may be higher than the height by which the belt-shaped member 60 takes up the liquid along the direction of gravitational force Z. The slope area A3 may have a volumetric capacity capable of absorbing and retaining the liquid adhering to the contact portion 60*a*.

The horizontal area A4 is an area that extends from the uppermost portion of the first horizontal roller 78 to the uppermost portion of the second horizontal roller 79. The first horizontal roller 78 and the second horizontal roller 79 are provided at the same height in the direction of gravitational force Z, and keep substantially horizontal a portion of the belt-shaped member 60 located in the horizontal area A4. The horizontal area A4 is located below the second opening 67, and the portion of the belt-shaped member 60 located in the horizontal area A4 is exposed through the second opening 67.

Figure 6:
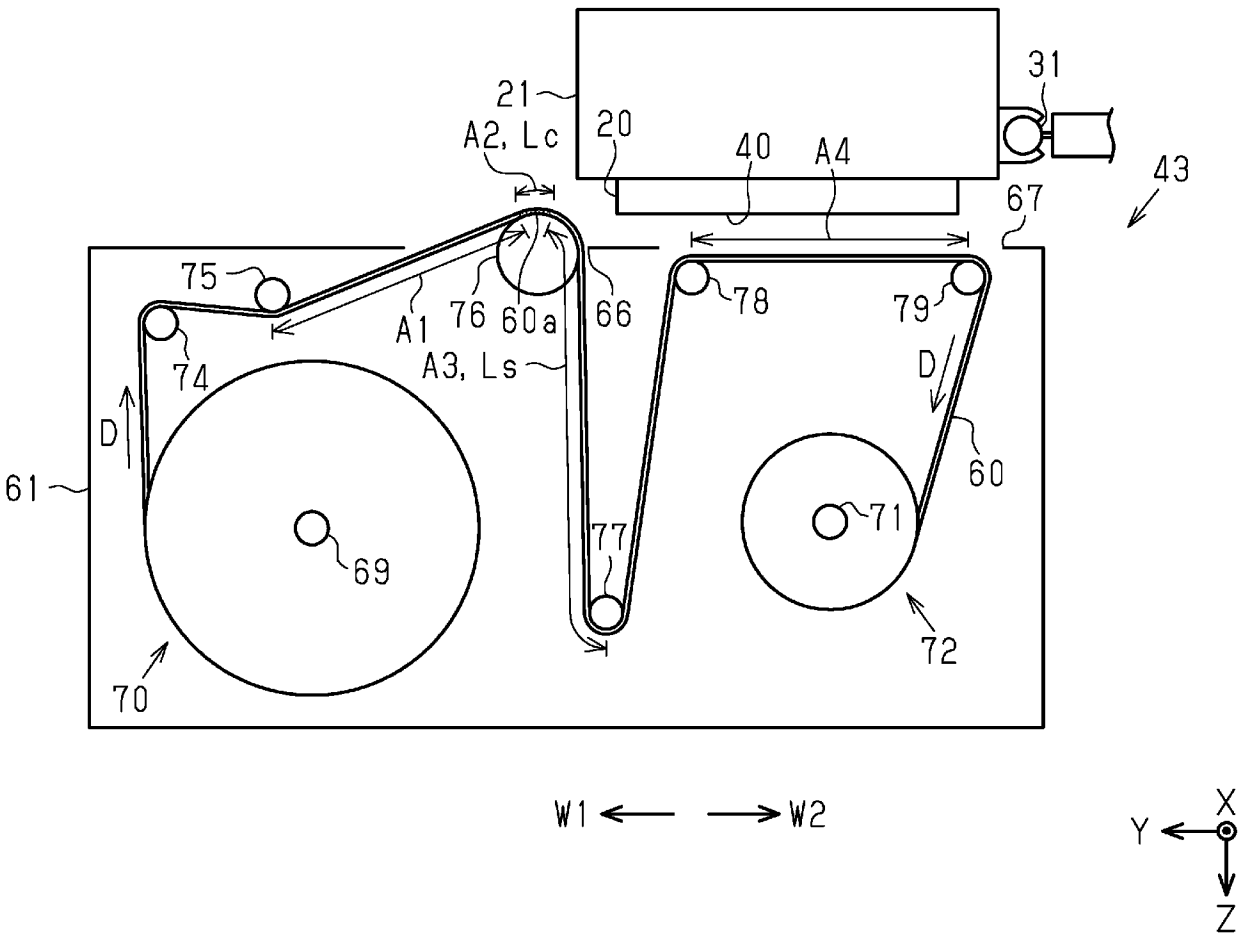
FIG. 6 is a schematic side view of the liquid collecting device with its case located in a receiving position.

As shown in FIG. 6, when the case 61 is located in the receiving position and the liquid ejecting portion 20 is located in the cleaning position CP, the portion of the belt-shaped member 60 located in the horizontal area A4 faces the nozzle surface 40. In this state, the liquid ejecting apparatus 11 may perform pressurized cleaning by which to discharge a pressurized liquid from the nozzles 36. That is, the liquid collecting device 43 may receive a liquid that is discharged by pressurized cleaning.

Working effects of the present embodiment are described.

First, a case where the control portion 29 performs suction cleaning, wiping, and flashing in sequence as maintenance of the liquid ejecting portion 20 is described.

The control portion 29 stops the liquid ejecting portion 20 above the suction device 44, and performs suction cleaning on a nozzle group that needs suction cleaning. Upon completion of suction cleaning, the control portion 29 moves the liquid ejecting portion 20 to the cleaning position CP.

As shown in FIG. 4, the control portion 29 drives the wiping motor 63 in a forward direction in a state where the case 61 is located in the waiting position, and moves the case 61 in the first wiping direction W1.

As shown in FIG. 5, the liquid collecting device 43 wipes the liquid ejecting portion 20 by bringing the contact portion 60*a* into contact with the liquid ejecting portion 20. Specifically, the liquid collecting device 43 performs wiping by the pressing portion 76 pressing the belt-shaped member 60 against the nozzle surface 40 and the case 61 moving with the belt-shaped member 60 held between the pressing portion 76 and the nozzle surface 40.

As shown in FIG. 6, once the case 61 moves to the receiving position, the control portion 29 stops driving of the wiping motor 63 and moves the liquid ejecting portion 20 from the cleaning position CP. After that, the control portion 29 drives the wiping motor 63 in a reverse direction and moves the case 61 in the second wiping direction W2.

Figure 7:
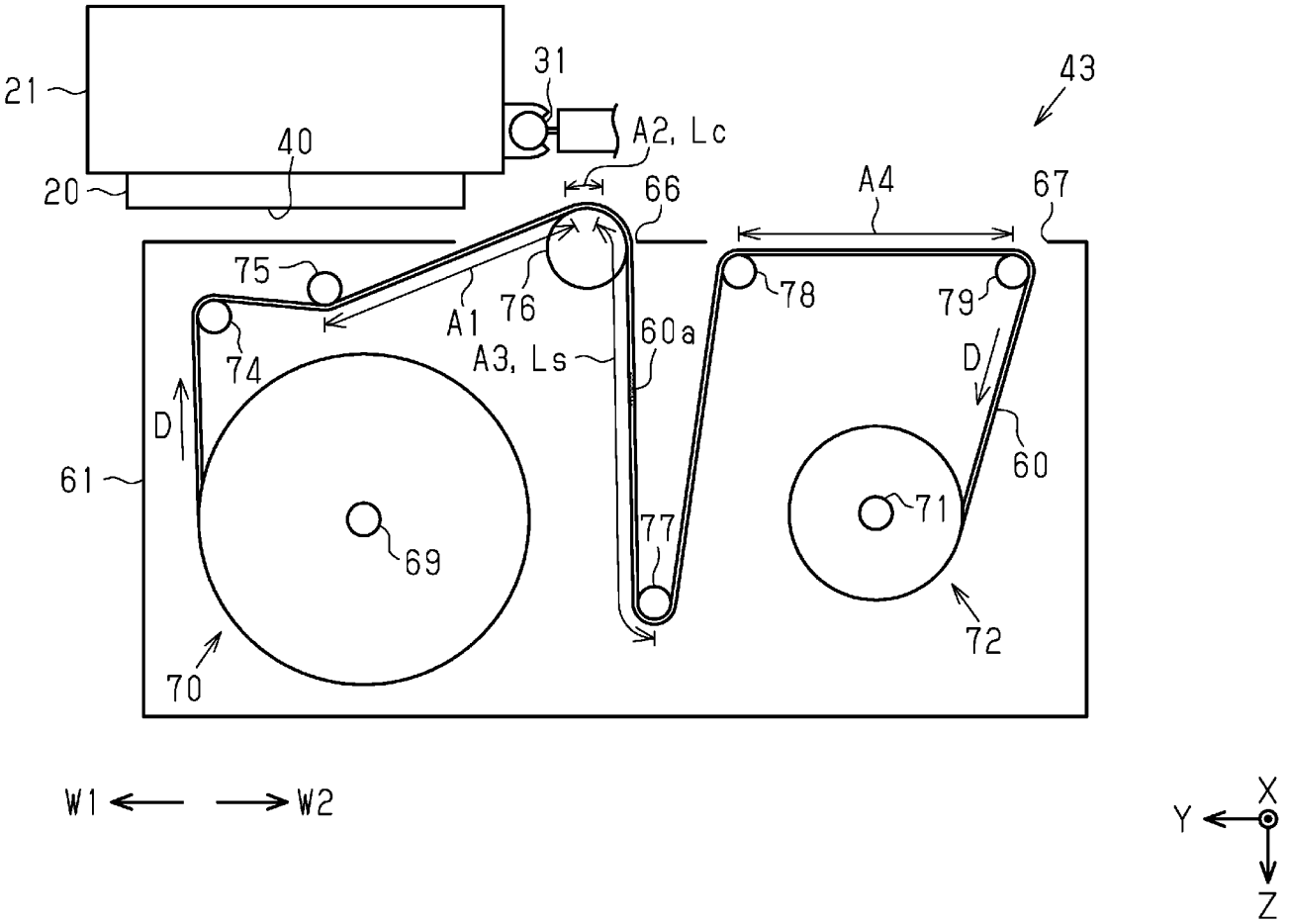
FIG. 7 is a schematic side view of the liquid collecting device with its belt-shaped member wound up.

As shown in FIG. 7, once the case 61 returns to the waiting position, the control portion 29 drives the winding motor 64. The winding portion 72 moves the control portion 60*a* in the direction of movement D by winding up the belt-shaped member 60. At this point in time, the control portion 29 may move the contact portion 60*a* to the slope area A3 by causing the winding portion 72 to wind up the belt-shaped member 60 by a length longer than the contact length Lc.

The liquid absorbed into the belt-shaped member 60 by wiping diffuses within the belt-shaped member 60. Moreover, when the liquid is an ink, both solvent and pigment components of the ink, which diffuses within the belt-shaped member 60, diffuse. When the contact portion 60*a* is located in the contact area A2, the action of gravity makes it easy for the liquid to diffuse toward the slope area A3, whose slope with respect to the contact area A2 is large, but also cause the liquid to diffuse into the upstream area A1, whose slope with respect to the contact area A2 is small. A range of diffusion of the liquid into the belt-shaped member 60 becomes larger with passage of time. Therefore, the control portion 29 may cause the belt-shaped member 60 to be wound up by a longer length as the time from a point of time at which the belt-shaped member 60 started wiping to a point of time at which the belt-shaped member 60 is wound up becomes longer. Further, when the contact portion 60*a* is moved to the slope area A3 by winding up the belt-shaped member 60, the action of gravity makes it harder for the liquid to diffuse toward the contact area A2, which is closer to the feeding portion 70 than the slope area A3, than when the contact portion 60*a* is located in the contact area A2. However, the action of force by which the belt-shaped member 60 takes up the liquid along the direction of gravitational force Z causes the liquid to diffuse toward the contact area A2, which is closer to the feeding portion 70. Therefore, the control portion 29 may cause the belt-shaped member 60 to be wound up by a longer length as the elapsed time from a point of time at which the belt-shaped member 60 started wiping to an estimated time of next wiping becomes longer. That is, the control portion 29 may cause the belt-shaped member 60 to be wound up by a length equal to or longer than a total of a length by which the liquid is estimated to diffuse from the control area A2 in a direction opposite to the direction of movement D and the contact length Lc.

Upon completion of wiping, the control portion 29 moves the liquid ejecting portion 20 in the width direction X or in a direction opposite to the width direction X, and performs flushing by which to eject a liquid from the liquid ejecting portion 20 at a timing when the liquid ejecting portion 20 passes through the liquid receiving portion 47.

Next, a case where the control portion 29 performs pressurized cleaning, wiping, and flushing in sequence as maintenance of the liquid ejecting apparatus 11 is described.

As shown in FIGS. 3 and 6, when performing pressurized cleaning, the control portion 29 moves the case 61 to the receiving position and stops it there. After that, the control portion 29 moves the liquid ejecting portion 20 to the cleaning position CP and stops it there.

The control portion 29 controls the liquid supply device 23 to supply a pressurized liquid to the nozzles 36 and causes the liquid to be discharged from the nozzles 36. The liquid discharged from the nozzles 36 stays on the nozzle surface 40 in such a manner as to wet-spread across the nozzle surface 40. When the amount of liquid that stays on the nozzle surface 40 becomes larger, the liquid drops from the nozzle surface 40. At this point in time, the belt-shaped member 60 is located directly below the nozzles 36. Therefore, in pressurized cleaning, the liquid staying on the nozzle surface 40 is received by the portion of the belt-shaped member 60 located in the horizontal area A4.

As shown in FIG. 5, after having performed pressurized cleaning, the control portion 29 moves the case 61 in the second wiping direction W2 by driving the wiping motor 63 in a reverse direction while stopping the liquid ejecting portion 20. That is, the control portion 29 performs wiping with the belt-shaped member 60 to wipe off the liquid, discharged by pressurized cleaning, that remains on the nozzle surface 40. After having performed wiping, the control portion 29 moves the liquid ejecting portion 20 and performs flushing.

When the amount of liquid adhering to the contact portion 60*a* is large, the control portion 29 may make a length of the belt-shaped member 60 to be wound up by the winding portion 72 after the belt-shaped member 60 has been brought into contact with the liquid ejecting portion 20 longer than when the amount of liquid adhering to the contact portion 60*a* is small. That is, the amount of liquid that adheres to the nozzle surface 40 by pressurized cleaning is larger than the amount of liquid that adheres to the nozzle surface 40 by suction cleaning. Therefore, the control portion 29 may make a length of the belt-shaped member 60 that is wound up in association with wiping after pressurized cleaning longer than a length of the belt-shaped member 60 that is wound up in association with wiping after suction cleaning.

Effects of the present embodiment are described.

(1) The action of gravity makes it easier for the liquid absorbed into the belt-shaped member 60 to diffuse in the direction of gravitational force Z than in a horizontal direction. Therefore, as the slope of the belt-shaped member 60 with respect to the horizontal plane becomes larger, it becomes easier for the liquid to diffuse. In that regard, the belt-shaped member 60 wipes the liquid ejecting portion 20 by bringing the contact portion 60*a* being pressed by the pressing portion 76 into contact with the liquid ejecting portion 20, and the slope of a portion of the belt-shaped member 60 that extends downstream of the pressing portion 76 and toward a lower position than the pressing portion 76 is larger than the slope of a portion of the belt-shaped member 60 that extends upstream of the pressing portion 76 and toward a lower position than the pressing portion 76. That is, the liquid adhering to the contact portion 60*a* by being wiped off from the liquid ejecting portion 20 easily spreads downstream along the direction of movement D but hardly spreads upstream along the direction of movement D. This makes it possible to, when the winding portion 72 winds up the belt-shaped member 60 to move the contact portion 60*a* downstream along the direction of movement D, reduce a risk that a portion of the belt-shaped member 60 to which the liquid is adhering may remain in the contact area A2 and reduce a risk that the liquid ejecting portion 20 may be wiped with the portion of the belt-shaped member 60 to which the liquid is adhering.

(2) The slope length Ls, which is the length of the slope area A3 along the direction of movement D, is longer than the contact length Lc, which is the length of the contact portion 60*a* along the direction of movement D. This makes it possible to, by winding up the belt-shaped member 60 with the winding portion 72, to relocate the contact portion 60*a* out of the contact area A2 into the slope area A3. The height H of the slope area A3 along the direction of gravitational force Z is higher than the height by which the belt-shaped member 60 takes up the liquid. This makes it possible to, by utilizing a gravitational force acting on the liquid adhering to the belt-shaped member 60, make it hard for the liquid adhering to the contact portion 60*a* to spread to the contact area A2 after the contact area 60*a* has moved to the slope area A3.

(3) The control portion 29 winds up the belt-shaped member 60 after having brought the contact portion 60*a* into contact with the liquid ejecting portion 20. The length by which to wind up the belt-shaped member 60 at this point in time is longer than the contact length Lc of the contact portion 60*a*. This makes it possible to, even when the liquid adhering to the contact portion 60*a* spreads upstream along the direction of movement D, reduce a risk that a portion of the belt-shaped member 60 to which the liquid is adhering may remain in the contact area A2 and reduce a risk that the liquid ejecting portion 20 may be wiped with the portion of the belt-shaped member 60 to which the liquid is adhering.

(4) The liquid adhering to the contact portion 60*a* more easily spreads to the outside of the contact area A2 and more easily spreads to a wider range as the amount of adhesion becomes larger. In that regard, when the amount of liquid adhering to the contact portion 60*a* is large, the belt-shaped member 60 is wound up by a longer length than when the amount of liquid adhering to the contact portion 60*a* is small. This makes it possible to make it hard for the contact area A2 to remain with a portion to which the liquid spread upstream along the direction of movement D adheres.

(5) The belt-shaped member 60 has, in the slope area A3, a volumetric capacity capable of retaining the liquid adhering to the contact portion 60*a*. This makes it possible to, when the contact portion 60*a* has been moved to the slope area A3, retain the liquid adhering to the belt-shaped member 60 in the slope area A3 and make it hard for the liquid adhering to the contact portion 60*a* to spread to the contact area A2.

(6) Since the slope of the belt-shaped member 60 with respect to the horizontal plane in the slope area A3 is larger than the slope of the belt-shaped member 60 with respect to the horizontal plane in the upstream area A1, the liquid adhering to the contact portion 60*a* easily spreads downstream along the direction of movement D but hardly spreads upstream along the direction of movement D. This makes it possible to reduce the winding amount also when winding up the belt-shaped member 60 in consideration of the spread of the liquid adhering to the contact area A2 upstream from the contact area A2 along the direction of movement D.

(7) The height H from the downstream end of the contact area A2 to the lowermost portion of the regulating roller 77 along the direction of gravitational force Z is higher than the height by which the belt-shaped member 60 takes up the liquid to the contact area A2 from the lowermost portion of the regulating roller 77. Therefore, moving the contact portion 60*a* to which the liquid is adhering to the lowermost portion of the regulating roller 77 makes it possible for example to, even when the amount of liquid adhering to the contact portion 60*a* is larger than the amount that can be retained in the slope area A3, make it hard for the liquid spreading upstream along the direction of movement D from the contact portion 60*a* through the belt-shaped member 60 to reach the contact area A2.

The present embodiment can be carried out in the following modifications. The present embodiment and the following modifications can be carried out in combination with each other as long as no technical contradiction arises.

Figure 8:
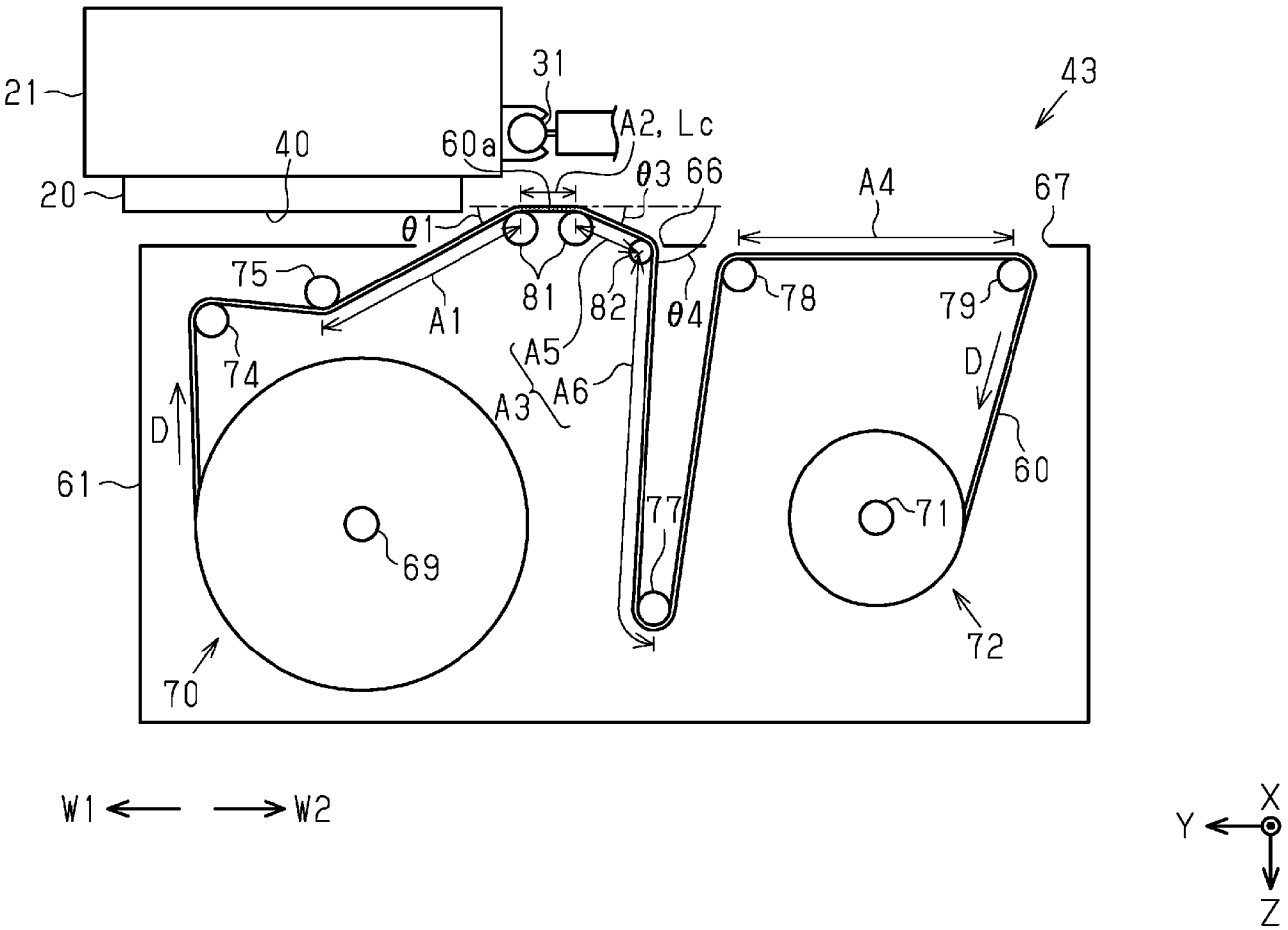
FIG. 8 is a schematic side view of a liquid collecting device according to a first modification.

As in a first modification shown in FIG. 8, the pressing portion may be constituted by a plurality of pressing rollers 81. When the liquid collecting device 43 includes two pressing rollers 81, the contact area A2 is a space between the respective upper ends of the pressing rollers 81. The liquid collecting device 43 may include a downstream roller 82 provided between the pressing rollers 81 and the regulating roller 77 in the path of transportation of the belt-shaped member 60. The slope area A3 may include a gentle slope area A5 whose slope is gentle and a steep slope area A6 whose slope is steep. Specifically, the gentle slope area A5 extends from the downstream end of the contact area A2 to the downstream roller 82 along the direction of movement D. The steep slope area A6 extends from the downstream roller 82 to the lowermost portion of the regulating roller 77 along the direction of movement D. The steep slope area A6 is located downstream of the gentle slope area A5 along the direction of movement D. A gentle angle θ3 formed by the horizontal plane and a portion of the belt-shaped member 60 located in the gentle slope area A5 may be smaller than 30 degrees or may be equal to the upstream angle θ1. Making the gentle angle θ3 and the upstream angle θ1 equal makes it possible to wipe the nozzle surface 40 in the same way both in wiping by which to move the case 61 in the first wiping direction W1 and wiping by which to move the case 61 in the second wiping direction W2. A steep angle θ4 formed by the horizontal plane and a portion of the belt-shaped member 60 located in the steep slope area A6 may be larger than the upstream angle θ1 and the gentle angle θ3 and equal to or larger than the downstream angle θ2. In other words, the slope of a portion of the belt-shaped member 60 that extends downstream along the direction of movement D and toward a lower position in the steep slope area A6 is larger than the slope of a portion of the belt-shaped member 60 that extends upstream along the direction of movement D and toward a lower position in the upstream area A1. After having performed wiping by bringing the contact portion 60*a* into contact with the liquid ejecting portion 20, the control portion 29 may cause the winding portion 72 to wind up the belt-shaped member 60 by a length longer than a total of the contact length Lc and the length of the gentle slope area A5 along the direction of movement D. That is, the control portion 29 may move, to the steep slope area A6, the contact portion 60*a* into which the liquid has been absorbed in association with wiping.

Figure 9:
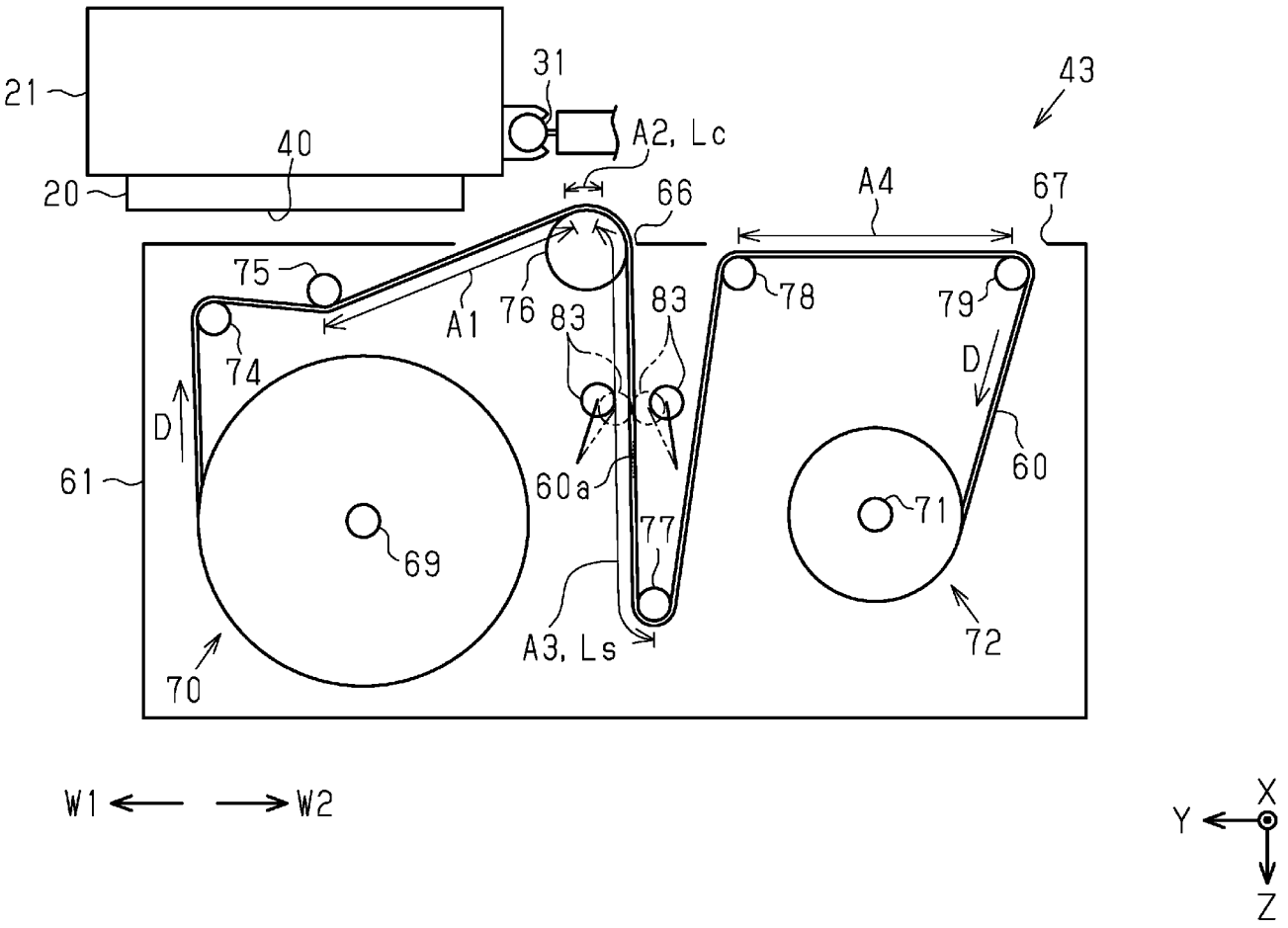
FIG. 9 is a schematic side view of a liquid collecting device according to a second modification.

As in a second modification shown in FIG. 9, the liquid collecting device 43 may include a nip roller 83 that nips the belt-shaped member 60. The control portion 29 may wind up the belt-shaped member 60 with a pair of the nip rollers 83 located in a release position indicated by solid lines in FIG. 9 and, after the contact portion 60*a* has passed through the nip roller 83, locate the pair of nip rollers 83 in a nip position indicated by chain double-dashed lines in FIG. 9. Nipping the belt-shaped member 60 with the nip roller 83 makes it possible to reduce a risk that the liquid retained in the contact portion 60*a* may diffuse upstream of the nip roller 83. Accordingly, for example, the volumetric capacity of the belt-shaped member 60 in the slope area A3 may be smaller than the volumetric capacity capable of absorbing and retaining the liquid adhering to the contact portion 60*a*. The height H of the slope area A3 along the direction of gravitational force Z may be lower than the height by which the belt-shaped member 60 takes up the liquid along the direction of gravitational force Z. Even in such a case, it is possible to reduce a risk that the liquid adhering to the contact portion 60*a* diffuses to the contact area A2 after the contact portion 60*a* has moved to the slope area A3.

Figure 10:
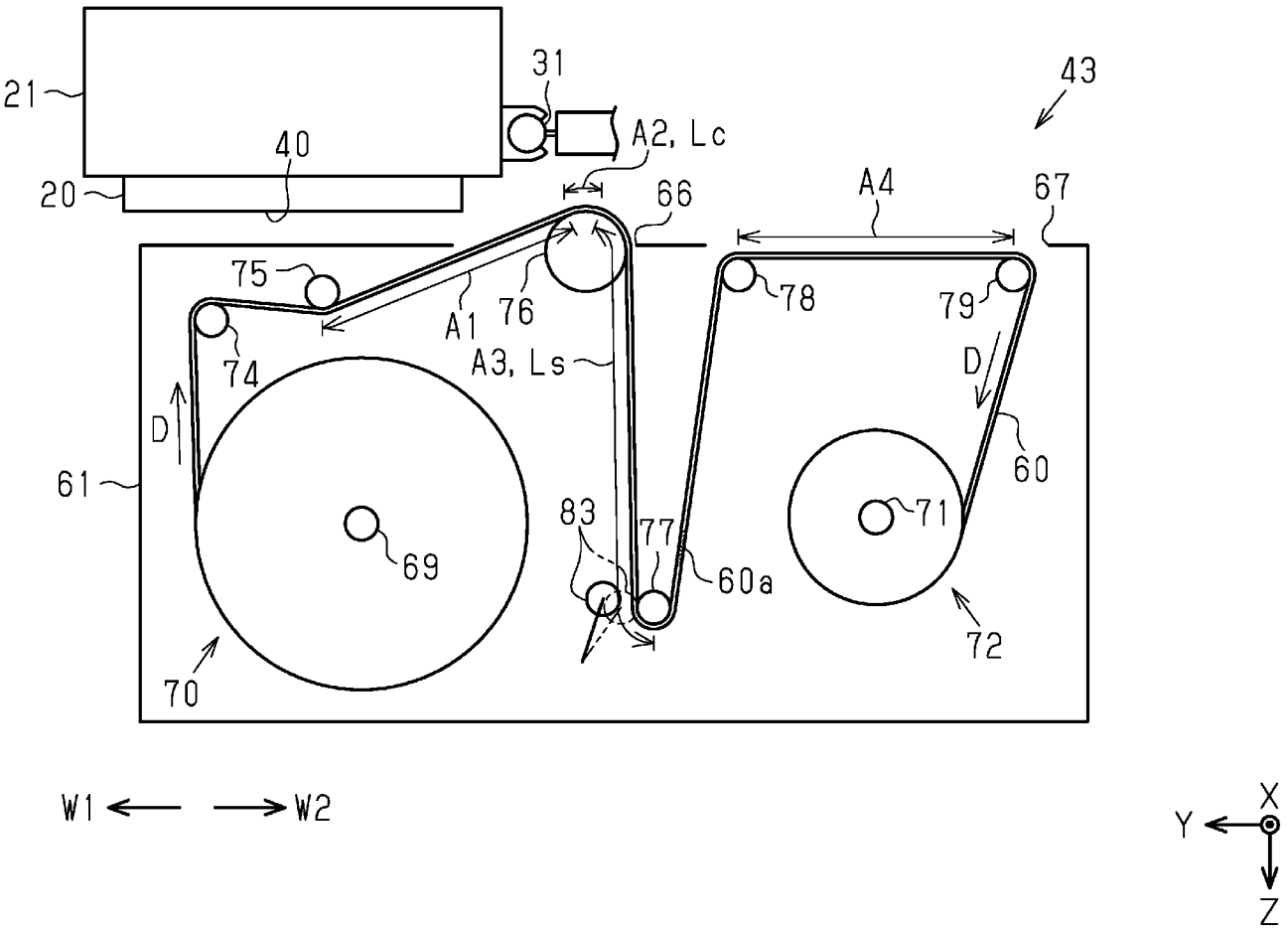
FIG. 10 is a schematic side view of a liquid collecting device according to a third modification.

As in a third modification shown in FIG. 10, the belt-shaped member 60 may be nipped between the nip roller 83 and the regulating roller 77. The control portion 29 may wind up the belt-shaped member 60 with the nip roller 83 located in a release position indicated by a solid line in FIG. 10 and, after the contact portion 60*a* has passed through the slope area A3, locate the nip roller 83 in a nip position indicated by a chain double-dashed line in FIG. 10.

A portion of the belt-shaped member 60 located in the slope area A3 may be nipped between the nip roller 83 and the pressing portion 76. The control portion 29 may wind up the belt-shaped member 60 with the nip roller 83 located in a release position and, after the contact portion 60*a* has moved to the slope area A3, nip the belt-shaped member 60 between the pressing portion 76 and the nip roller 83 with the nip roller 83 located in a nip position.

The liquid collecting device 43 may be configured to wind up the belt-shaped member 60 in the receiving position.

When it is impossible to estimate a period of time that elapses from the start of wiping by the belt-shaped member 60 to the next wiping, the control portion 29 may cause the belt-shaped member 60 to be wound up by a constant length. In this case, it is preferable that in an environment of usage of the liquid ejecting apparatus 11, the constant length be a total of the contact length Lc and a maximum diffusion length in a direction opposite to the direction of movement D from the contact area A2 toward the feeding portion 70 when a maximum elapsed time has elapsed from the adhesion of the liquid to the contact portion 60*a* to the stoppage of diffusion of the liquid within the belt-shaped member 60 and the range of diffusion has reached its maximum. For example, assume that, in wiping that is performed after cleaning, wiping in the first wiping direction W1 by the belt-shaped member 60 is performed consecutively twice. Moreover, when the time elapsed from the start of the first wiping to the second wiping is shorter than the maximum elapsed time and it is impossible to estimate a period of time that elapses from the start of the second wiping to the next wiping, the control portion 29 may make the length of a portion of the belt-shaped member 60 that is wound up in association with the first wiping shorter than the constant length, which serves as the length of a portion of the belt-shaped member 60 that is wound up in association with the second wiping.

For example, when the liquid is an ink, a pigment component of the ink absorbed into a wet belt-shaped member 60 diffuses for a longer time and over a wider range within the belt-shaped member 60 than a pigment component of the ink absorbed into a dry belt-shaped member 60. Therefore, when there is provided a wiping liquid supply mechanism capable of supplying the belt-shaped member 60 with a liquid for wiping, the control portion 29 may make the length of a portion of the belt-shaped member 60 that is wound up in association with wiping by the belt-shaped member 60 supplied with the wiping liquid longer than the length of a portion of the belt-shaped member 60 that is wound up in association with wiping by the belt-shaped member 60 supplied with no wiping liquid.

In wiping, the liquid collected from the nozzle surface 40 is collected into the contact area A2 and an area forward of the contact area A2 in a wiping direction. Further, the liquid absorbed into the belt-shaped member 60 hardly diffuses from an area interposed between the pressing portion 76 and the nozzle surface 40 to an area not interposed between the pressing portion 76 and the nozzle surface 40. Therefore, the control portion 29 may make the length of a portion of the belt-shaped member 60 that is wound up in association with wiping by which to feeding a side of the belt-shaped member 60 that is forward in the wiping direction longer than the length of a portion of the belt-shaped member 60 that is wound up in association with wiping by which to wind up the side of the belt-shaped member 60 that is forward in the wiping direction.

The liquid collecting device 43 may perform wiping after the belt-shaped member 60 has been wound up. In this case, it is not necessary to wind up the belt-shaped member 60 after having performed wiping. In a case of winding up the belt-shaped member 60 before wiping, the control portion 29 may change, based on the time elapsed since the previous wiping, the amount by which the belt-shaped member 60 is wound up.

The amount of liquid that adheres to the nozzle surface 40 by suction cleaning becomes larger as the number of nozzle groups that perform suction cleaning becomes larger. Therefore, when all of the nozzle groups have been subjected to suction cleaning, the control portion 29 may cause the belt-shaped member 60 to be wound up by a longer length than when one nozzle group has been subjected to suction cleaning.

The control portion 29 may perform a winding operation on the belt-shaped member 60 more than once during a period from wiping to next wiping. In this case, the length by which to wind up the belt-shaped member 60 with one winding operation may be shorter than the contact length Lc. For example, after having performed wiping by bringing the contact portion 60*a* into contact with the liquid ejecting portion 20, the control portion 29 may cause the belt-shaped member 60 to be wound up by a length from the upstream end of the contact portion 60*a* to the uppermost portion of the pressing portion 76 and cause the belt-shaped member 60 to be further wound up before the next wiping. The winding operation after the former wiping causes the upstream end of the contact portion 60*a* to be located downstream of the uppermost portion of the pressing portion 76. Therefore, the diffusion of the liquid upstream along the direction of movement D is reduced by the action of gravity, and a portion of the belt-shaped member 60 to which no liquid is adhering can be easily located in the contact area A2 by the winding operation that is performed before the latter wiping.

The slope length Ls of the slope area A3 along the direction of movement D may be equal to the contact length Lc of the contact portion 60*a* along the direction of movement D or shorter than the contact length Lc. In this case, the control portion 29 may cause the belt-shaped member 60 to be wound up so that at least a portion of the contact portion 60*a* passes through the slope area A3.

The liquid collecting device 43 may be configured not to include the regulating roller 77. For example, the slope area A3 may be an area hanging down downstream from the pressing portion 76 along the direction of movement D.

The liquid ejecting apparatus 11 may be a liquid ejecting apparatus that ejects or discharges a liquid other than an ink. Forms of liquid that are discharged as liquid drops of minutely small amounts from the liquid ejecting apparatus include granular forms, tear-drop forms, and filiform trail forms. The liquid here needs only be a material that can be ejected from the liquid ejecting apparatus. For example, the liquid needs only assume a state that a substance assumes when it is in a liquid phase, and examples of the liquid include a high-viscosity or low-viscosity liquid, a sol, gel water, and other fluids such as an inorganic solvent, an organic solvent, a solution, a liquid resin, a liquid metal, and a metallic melt. The liquid encompasses not only a liquid as one state of a substance but also a dissolution, dispersion, or mixture in a solvent of particles of functional materials composed of solids such as pigments and metallic particles. Typical examples of the liquid include inks and liquid crystal such as those described in the foregoing embodiment. The term "inks" here encompasses various types of liquid composition such as common water-based inks and oil-based inks, gel inks, and hot-melt inks. A specific example of the liquid ejecting apparatus is an apparatus that ejects a liquid containing, in the form of a dispersion or dissolution, a material, such as an electrode material or a color material, that is used in the manufacture of a liquid crystal display, an electroluminescence display, a surface-emitting display, or a color filter. The liquid ejecting apparatus may be an apparatus that ejects a bioorganic substance that is used in the manufacture of a biochip, an apparatus, used as a precision pipette, that ejects a liquid serving as a specimen, a textile printing apparatus, a microdispenser, or the like. The liquid ejecting apparatus may be an apparatus that pinpoint-ejects lubricating oil into a precision machine such as a timepiece or a camera or an apparatus that ejects a liquid of transparent resin such as ultraviolet-curable resin onto a substrate in order to form a microhemispherical lens or an optical lens for use in an optical communication element or the like. The liquid ejecting apparatus may be an apparatus that ejects an etching liquid such as an acid or an alkali in order to etch a substrate or the like.

The following describes technical ideas understood from the aforementioned embodiment and modifications and working effects thereof.

(A) A liquid collecting device includes a belt-shaped member configured to absorb a liquid, a feeding portion that has a feeding shaft and that retains the belt-shaped member in a rolled state, a pressing portion configured to press a contact portion of a portion of the belt-shaped member wound off from the feeding portion and bring the contact portion into contact with a liquid ejecting portion configured to eject the liquid, the contact portion being located in a contact area, and a winding portion that has a winding shaft and that is configured to move the contact portion in a direction of movement by winding up the belt-shaped member. A slope of a portion of the belt-shaped member that extends downstream along the direction of movement and toward a lower position in a slope area provided downstream of the pressing portion along the direction of movement is larger than a slope of a portion of the belt-shaped member that extends upstream of the pressing portion along the direction of movement and toward a lower position than the pressing portion.

The action of gravity makes it easier for the liquid absorbed into the belt-shaped member to diffuse in a direction of gravitational force than in a horizontal direction. Therefore, as the slope of the belt-shaped member with respect to a horizontal plane becomes larger, it becomes easier for the liquid to diffuse. In that regard, according to this configuration, the belt-shaped member wipes the liquid ejecting portion by bringing the contact portion being pressed by the pressing portion into contact with the liquid ejecting portion, and the slope of a portion of the belt-shaped member that extends downstream of the pressing portion and toward a lower position than the pressing portion is larger than the slope of a portion of the belt-shaped member that extends upstream of the pressing portion and toward a lower position than the pressing portion. That is, the liquid adhering to the contact portion by being wiped off from the liquid ejecting portion easily spreads downstream along the direction of movement but hardly spreads upstream along the direction of movement. This makes it possible to, when the winding portion winds up the belt-shaped member to move the contact portion downstream along the direction of movement, reduce a risk that a portion of the belt-shaped member to which the liquid is adhering may remain in the contact area and reduce a risk that the liquid ejecting portion may be wiped with the portion of the belt-shaped member to which the liquid is adhering.

(B) The liquid collecting device according may further include a regulating roller that is disposed downstream of the pressing portion along the direction of movement and in a lower position than the pressing portion and that regulates the belt-shaped member toward a lower position than the pressing portion. The slope area may be an area that extends from a downstream end of the contact area to a lowermost portion of the regulating roller with which the belt-shaped member makes contact. A length of the slope area along the direction of movement may be longer than a contact length of the contact portion along the direction of movement. A height of the slope area along a direction of gravitation force may be higher than a height by which the belt-shaped member takes up the liquid along the direction of gravitational force.

According to this configuration, a slope length, i.e. the length of the slope area along the direction of movement, is longer than a contact length, i.e. the length of the contact portion along the direction of movement. This makes it possible to, by winding up the belt-shaped member with the winding portion, to relocate the contact portion out of the contact area into the slope area. The height of the slope area along the direction of gravitational force is higher than the height by which the belt-shaped member takes up the liquid. This makes it possible to, by utilizing a gravitational force acting on the liquid adhering to the belt-shaped member, make it hard for the liquid adhering to the contact portion to spread to the contact area after the contact area has moved to the slope area.

(C) A liquid ejecting apparatus includes a liquid ejecting portion that ejects a liquid, a belt-shaped member configured to absorb the liquid, a feeding portion that has a feeding shaft and that retains the belt-shaped member in a rolled state, a pressing portion configured to press a contact portion of a portion of the belt-shaped member wound off from the feeding portion and bring the contact portion into contact with the liquid ejecting portion, the contact portion being located in a contact area, a winding portion that has a winding shaft and that is configured to move the contact portion in a direction of movement by winding up the belt-shaped member, and a control portion that, when it is assumed that a contact length is a length of the contact portion along the direction of movement, causes the winding portion to wind up the belt-shaped member by a length longer than the contact length after bringing the contact portion into contact with the liquid ejecting portion.

According to this configuration, the control portion winds up the belt-shaped member after having brought the contact portion into contact with the liquid ejecting portion. The length by which to wind up the belt-shaped member at this point in time is longer than the contact length of the contact portion. This makes it possible to, even when the liquid adhering to the contact portion spreads upstream along the direction of movement, reduce a risk that a portion of the belt-shaped member to which the liquid is adhering may remain in the contact area and reduce a risk that the liquid ejecting portion may be wiped with the portion of the belt-shaped member to which the liquid is adhering.

(D) In the liquid ejecting apparatus, when a large amount of the liquid adheres to the contact portion, the control portion may cause the winding portion to wind up the belt-shaped member by a longer length after bringing the belt-shaped member into contact with the liquid ejecting portion than when a small amount of the liquid adheres to the contact portion.

The liquid adhering to the contact portion more easily spreads to the outside of the contact area and more easily spreads to a wider range as the amount of adhesion becomes larger. In that regard, according to this configuration, when the amount of liquid adhering to the contact portion is large, the belt-shaped member is wound up by a longer length than when the amount of liquid adhering to the contact portion is small. This makes it possible to make it hard for the contact area to remain with a portion to which the liquid spread upstream along the direction of movement adheres.

(E) In the liquid ejecting apparatus, a slope of a portion of the belt-shaped member that extends downstream along the direction of movement and toward a lower position in a slope area provided downstream of the pressing portion along the direction of movement may be larger than a slope of a portion of the belt-shaped member that extends upstream of the pressing portion along the direction of movement and toward a lower position than the pressing portion. This configuration makes it possible to bring about effects which are similar to those of the liquid collecting device.

(F) The liquid ejecting apparatus may further include a regulating roller that is disposed downstream of the pressing portion along the direction of movement and in a lower position than the pressing portion and that regulates the belt-shaped member toward a lower position than the pressing portion. The slope area may be an area that extends from a downstream end of the contact area to a lowermost portion of the regulating roller with which the belt-shaped member makes contact. A length of the slope area along the direction of movement may be longer than the contact length. The slope area may have a volumetric capacity configured to absorb and retain the liquid adhering to the contact portion.

According to this configuration, a slope length, i.e. the length of the slope area along the direction of movement, is longer than a contact length, i.e. the length of the contact portion along the direction of movement. This makes it possible to, by winding up the belt-shaped member with the winding portion, to relocate the contact portion out of the contact area into the slope area. The belt-shaped member has, in the slope area, a volumetric capacity capable of retaining the liquid adhering to the contact portion. This makes it possible to, when the contact portion has been moved to the slope area, retain the liquid adhering to the belt-shaped member in the slope area and make it hard for the liquid adhering to the contact portion to spread to the contact area.

(G) In the liquid ejecting apparatus, a height of the slope area along a direction of gravitation force may be higher than a height by which the belt-shaped member takes up the liquid along the direction of gravitational force. This configuration makes it possible to bring about effects which are similar to those of the liquid collecting device.

(H) A method for controlling a liquid ejecting apparatus is a method for controlling a liquid ejecting apparatus including a liquid ejecting portion that ejects a liquid, a belt-shaped member configured to absorb the liquid, a feeding portion that retains the belt-shaped member in a rolled state, a pressing portion configured to press a contact portion of a portion of the belt-shaped member wound off from the feeding portion and bring the contact portion into contact with the liquid ejecting portion, the contact portion being located in a contact area, and a winding portion configured to move the contact portion in a direction of movement by winding up the belt-shaped member. The method includes, when it is assumed that a contact length is a length of the contact portion along the direction of movement, causing the winding portion to wind up the belt-shaped member by a length longer than the contact length after bringing the contact portion into contact with the liquid ejecting portion. This method makes it possible to bring about effects which are similar to those of the liquid ejecting apparatus.

(I) In the method for controlling a liquid ejecting apparatus, when a large amount of the liquid adheres to the contact portion, the winding portion may be caused to wind up the belt-shaped member by a longer length after bringing the belt-shaped member into contact with the liquid ejecting portion than when a small amount of the liquid adheres to the contact portion. This method makes it possible to bring about effects which are similar to those of the liquid ejecting apparatus.

What is claimed is:

1. A liquid collecting device comprising:

a belt-shaped member configured to absorb a liquid;

a feeding portion that has a feeding shaft and that retains the belt-shaped member in a rolled state;

a pressing portion configured to press a contact portion of a portion of the belt-shaped member wound off from the feeding portion and bring the contact portion into contact with a liquid ejecting portion configured to eject the liquid, the contact portion being located in a contact area; and a winding portion that has a winding shaft and that is configured to move the contact portion in a movement direction by winding up the belt-shaped member, wherein a portion of the belt-shaped member that is in a slope area provided downstream along the moving direction from the pressing portion has a downward slope that is larger than a downward slope of a portion of the belt-shaped member that is in an area provided upstream along the moving direction from the pressing portion, and wherein a portion of the belt-shaped member includes a horizontal portion having a horizontal slope that is provided downstream of the pressing portion and upstream of the winding portion along the movement direction.

2. The liquid collecting device according to claim 1, further comprising a regulating roller that is disposed downstream of the pressing portion along the moving direction and regulates the belt-shaped member downward from the pressing portion, wherein the slope area is an area that extends from a downstream end of the contact area to a lowermost portion of the regulating roller, and a length of the slope area along the moving direction is longer than a contact length of the contact portion along the moving direction.

3. The liquid collecting device according to claim 1, wherein the contact portion has a horizontal slope.

4. The liquid collecting device according to claim 1, further comprising:

a nip roller provided in the slope area and configured to nip the belt-shaped member, wherein the nip roller nips the belt-shaped member after the contact portion has passed through the nip roller.

5. A liquid ejecting apparatus comprising:

a liquid ejecting portion that ejects a liquid;

a belt-shaped member configured to absorb the liquid;

a feeding portion that has a feeding shaft and that retains the belt-shaped member in a rolled state;

a pressing portion configured to press a contact portion of a portion of the belt-shaped member wound off from the feeding portion and bring the contact portion into contact with the liquid ejecting portion, the contact portion being located in a contact area;

a winding portion that has a winding shaft and that is configured to move the contact portion in a moving direction by winding up the belt-shaped member; and a control portion that, when it is assumed that a contact length is a length of the contact portion along the moving direction, causes the winding portion to wind up the belt-shaped member corresponding to a length longer than the contact length after wiping the liquid ejecting portion with the contact portion and separating the contact portion from the liquid ejecting portion.

6. The liquid ejecting apparatus according to claim 5, wherein when a large amount of the liquid adheres to the contact portion, the control portion causes the winding portion to wind up the belt-shaped member by a longer length after bringing the belt-shaped member into contact with the liquid ejecting portion than when a small amount of the liquid adheres to the contact portion.

7. The liquid ejecting apparatus according to claim 5, wherein a slope of a portion of the belt-shaped member toward downstream and downward along the moving direction in a slope area provided downstream from the pressing portion is larger than a slope of a portion of the belt-shaped member toward upstream and downward along the moving direction in an area provided upstream from the pressing portion.

8. The liquid ejecting apparatus according to claim 7, further comprising a regulating roller that is disposed downstream of the pressing portion along the moving direction and regulates the belt-shaped member downward from the pressing portion, wherein the slope area is an area that extends from a downstream end of the contact area to a lowermost portion of the regulating roller, a length of the slope area along the moving direction is longer than the contact length, and the slope area has a volume that absorbs and retains the liquid adhering to the contact portion.

9. The liquid ejecting apparatus according to claim 5, wherein a portion of the belt-shaped member includes a horizontal portion having a horizontal slope that is provided downstream of the pressing portion and upstream of the winding portion along the movement direction.

10. The liquid ejecting apparatus according to claim 9, further comprising:

a pressurizing portion configured to pressurize the liquid in the liquid ejecting portion, wherein the horizontal portion is configured to receive the liquid discharged from the liquid ejecting portion by the pressurization of the pressurizing portion.

11. The liquid ejecting apparatus according to claim 9, wherein in a direction in which the pressing portion presses the contact portion, a distance between the horizontal portion and the liquid ejecting portion is longer than a distance between the contact portion and the liquid ejecting portion.

12. A method for controlling a liquid ejecting apparatus including a liquid ejecting portion that ejects a liquid, a belt-shaped member configured to absorb the liquid, a feeding portion that retains the belt-shaped member in a rolled state, a pressing portion configured to press a contact portion of a portion of the belt-shaped member wound off from the feeding portion and bring the contact portion into contact with the liquid ejecting portion, the contact portion being located in a contact area, and a winding portion configured to move the contact portion in a direction of movement by winding up the belt-shaped member, the method comprising;

when it is assumed that a contact length is a length of the contact portion along the moving direction, causing the winding portion to wind up the belt-shaped member corresponding to a length longer than the contact length after wiping the liquid ejecting portion with the contact portion and separating the contact portion from the liquid ejecting portion.

13. The method according to claim 12, wherein when a large amount of the liquid adheres to the contact portion, the winding portion is caused to wind up the belt-shaped member by a longer length after bringing the belt-shaped member into contact with the liquid ejecting portion than when a small amount of the liquid adheres to the contact portion.

* * * * *